United States Patent [19]

Bohme et al.

[11] 4,188,165

[45] Feb. 12, 1980

[54] LOADERS FOR USE IN TUNNELS

[75] Inventors: Rolf C. Bôhme, Johannesburg; Dieter G. Lück, Kyalami Ext. 1, both of South Africa

[73] Assignee: General Mining and Finance Corporation Limited, South Africa

[21] Appl. No.: 838,111

[22] Filed: Sep. 29, 1977

[30] Foreign Application Priority Data

Oct. 1, 1976 [ZA] South Africa ..... 76/5915

[51] Int. Cl.[2] ..... E02F 3/00

[52] U.S. Cl. ..... 414/694; 37/135; 414/709

[58] Field of Search ..... 214/138 R, 772, 132, 214/1 MS, 78; 212/66; 37/71, 103, 118 A, 125, 135; 414/694, 709, 687, 695

[56] References Cited

U.S. PATENT DOCUMENTS

| | | | |
|---|---|---|---|
| 1,256,401 | 2/1918 | Ward | 214/78 |
| 2,109,388 | 2/1938 | Heller | 214/138 R X |
| 2,119,139 | 5/1938 | Owen et al. | 214/78 |
| 2,347,456 | 4/1974 | Becuwith | 214/132 X |

FOREIGN PATENT DOCUMENTS

| | | | |
|---|---|---|---|
| 936497 | 12/1955 | Fed. Rep. of Germany | 214/132 |
| 798711 | 3/1936 | France | 214/138 R |
| 729419 | 5/1955 | United Kingdom | 214/132 |

*Primary Examiner*—Frank E. Werner

*Attorney, Agent, or Firm*—Morgan, Finnegan, Pine, Foley & Lee

[57] ABSTRACT

A loader comprises a bucket at the end of a dipper arm swinging from a cross-member on an upstanding yoke. The dipper arm swings between the uprights to the yoke for the bucket to pick up material on one side and deposit it on the other side. A winch actuates the bucket to dig and lift on the one side and a cam causes the bucket to turn upside down on the other side to deposit its load. The yoke can lean to the one side to extend the reach of the dipper arm and can slew about a vertical axis. The yoke can center itself when the dipper arm swings to the other side. For travelling the whole assembly can fold into a compact bundle.

9 Claims, 6 Drawing Figures

LOADERS FOR USE IN TUNNELS

BACKGROUND OF THE INVENTION

This invention relates to loaders for use in tunnels and other working places with limited head room.

The loading of rock in mine tunnels is a problem because of the limited head room and slewing space that are available. High capacity loaders as are used on the surface cannot be employed in tunnels.

An object of the invention is to provide a loader which is suitable for loading rock in a mine tunnel and which will have a reasonably high capacity.

SUMMARY OF THE INVENTION

According to the invention a loader comprises:

a base;

a yoke extending above the base and having uprights spaced apart by a cross-member between the uprights;

a shaft between the uprights;

a dipper arm swinging from the cross-member to move to either side of the yoke;

means to cause the dipper arm to swing between a loading position at a first side of the yoke and an unloading position at the opposite second side of the yoke;

a bucket pivoted to the free end of the dipper arm about a first axis parallel to the shaft; and means to rotate the bucket about its pivot axis from a digging attitude to a load retaining attitude.

Furthermore the yoke may be pivoted to the base about an axis parallel to the shaft and may include means to cause the yoke to move about that axis for the yoke to lean towards its first side in order to extend the reach of the dipper arm.

The yoke may also be slewable about an axis perpendicular to the base to increase the mucking width of the bucket, but in that case it is preferred that the yoke be centralised before the dipper arm moves to its unloading position.

DESCRIPTION OF A PREFERRED EMBODIMENT

The illustrated loader has a base generally indicated as 10 which in this case is carried by a frame which is part of the loading ramp 12 of a mucking train. The frame has not been illustrated in detail for the sake of clarity. In any case it can take a variety of forms depending on the mucking train in use. The essence is that the base 10 is anchored to what is effectively an immovable object.

A yoke having two uprights 13 pivoted at 9 to the base 10 also has a cross-member spacing the uprights 13 apart so that in effect a portal frame is formed. As can be seen from the various side views the uprights 13 can pivot quite extensively about the points 9.

Figure 2:
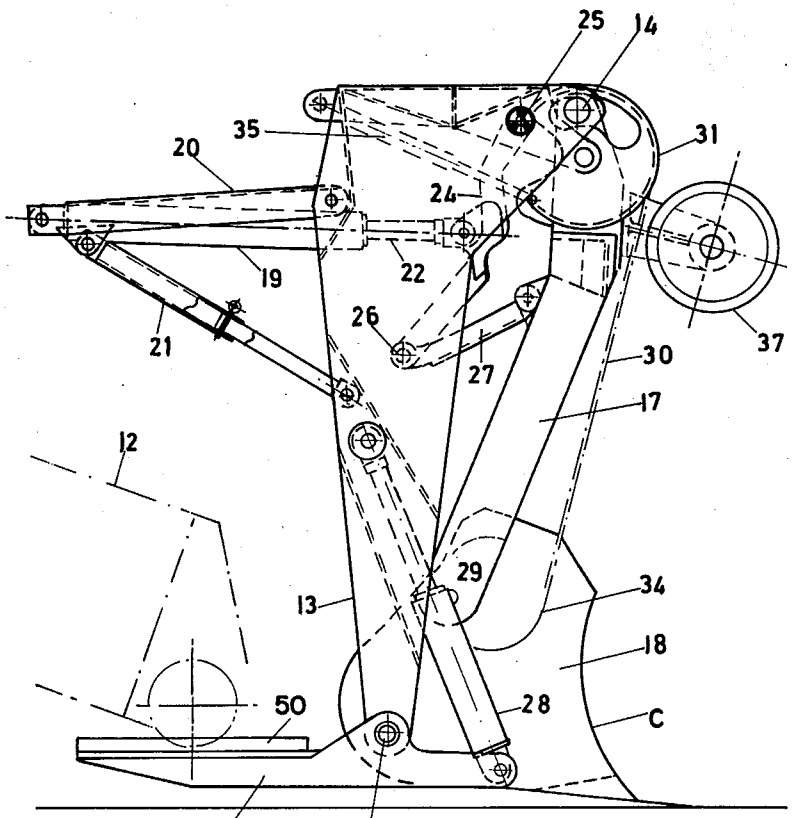
FIG. 2 is a side view of the loader in its starting position.
Figure 1:
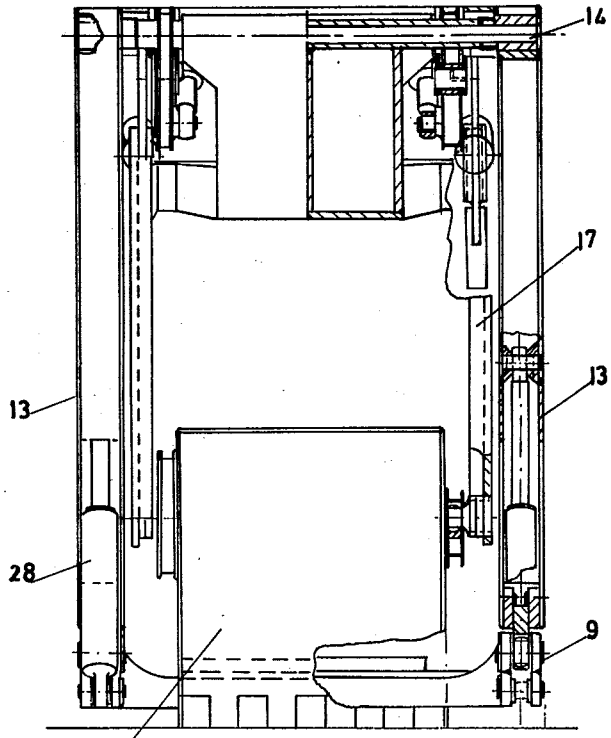
FIG. 1 is a front view of a loader according to the invention.
Figure 3:
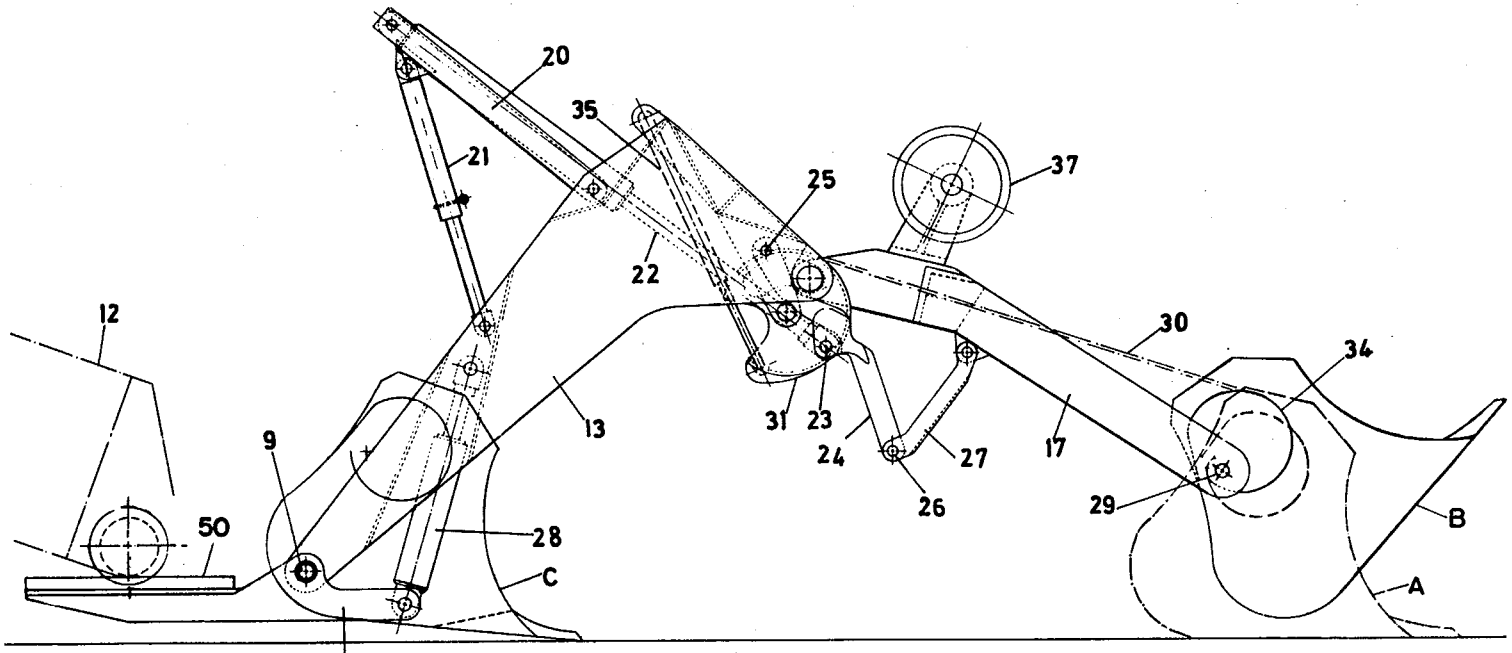
FIG. 3 is a side view showing the dipper arm fully extended.
Figure 6:
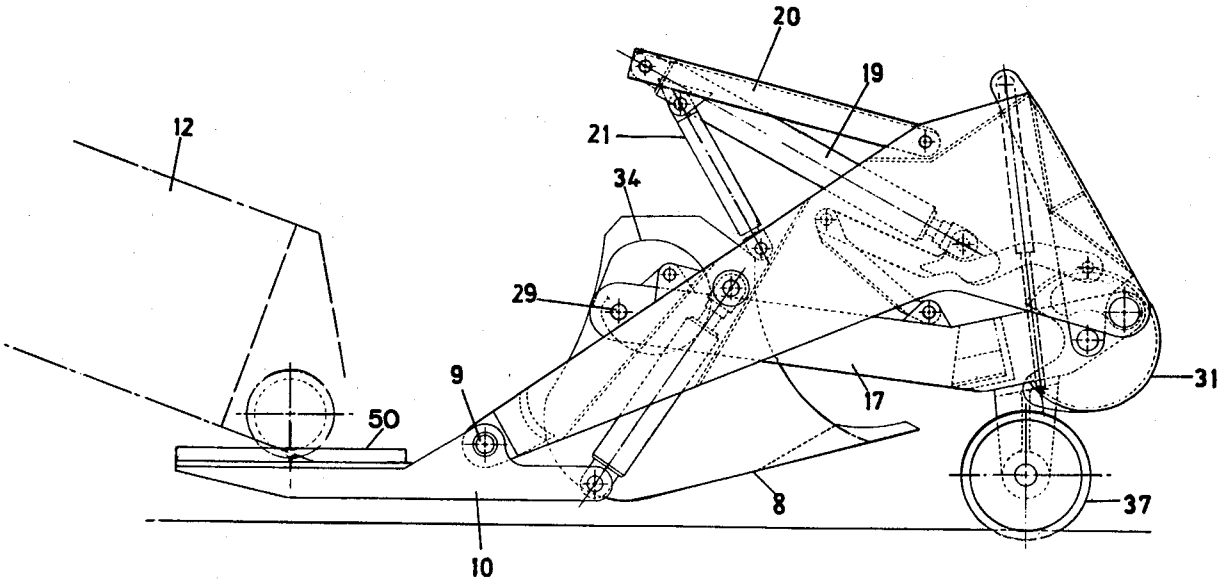
FIG. 6 is a side view in the travelling position.

Swinging from a shaft 14 between the uprights 13 is a forked dipper arm 17 (also a portal frame) which at its forked ends carries a loading bucket 18. Each of a pair of hydraulic cylinders 19 are fixed to an upright 13 by means of struts 20 and 21. Each strut 21 is collapsible as being formed as a single acting hydraulic cylinder. In use the strut 21 is always extended as shown in FIGS. 2, 3 and 6. For travelling purposes (FIG. 6) the strut 21 is collapsed in order to reduce the headroom required to pass the loader.

The actuating rod 22 of each cylinder 19 is pivoted at 23 to a lever 24 pivoted at 25 on an upright 13 and at 26 to another lever 27. At its other end the lever 27 is pivoted to the dipper arm 17. The levers 24 and 27 thus form a toggle mechanism for moving the dipper arm 17 and causing it to swing to and fro between the uprights 13.

A pair of hydraulic cylinders 28 tilt the uprights 13 about the pivot points 9. Thus the reach of the bucket 18 can be extended by lowering the upper parts of the uprights 13 as can be seen in FIG. 3.

The bucket 18 is pivoted at 29 on the free ends of the forks of the dipper arm 17. Two cammed cheeks 34 are fitted to either side of the bucket 18. A flexible element such as a rope or chain 30 passes from each cheek 34 to winch wheel 31 which is driven by a hydraulic cylinder 35. The wheel 31 has a segmental slot passing around the shaft 14 to allow movement of the wheel 31.

The cylinder 35 acts to bring the bucket 18 towards its load retaining attitude which is attitude B in FIG. 3. In order to ensure return of the bucket 18 to its digging attitude, a rope 42 applies a bias to the bucket 18. The rope 42 passes from the cheek 34 over a pulley 38 to a drum driven by a reversible positive displacement motor 36. During loading the motor 36 merely applies a bias to the bucket 18. If the cylinder 35 is actuated, that bias is overcome and the rope 42 unwinds from the drum on the motor 36.

In an operating position such as illustrated in FIG. 3 the cylinder 35 can cause the bucket 18 to operate between two attitudes indicated as attitudes A and B in FIG. 3. The axis of the wheel 31 and the axis 29 and the shape of the cammed cheeks 34 are so chosen that when the dipper arm moves to its unloading position (FIG. 5) the flexible element 30 is shortened and causes the bucket 18 to turn to the attitude illustrated in FIG. 5 and which has been marked as attitude D.

The starting position of the bucket 18 is position C marked in FIGS. 2 and 3.

The dipper arm is fitted with a pair of rail wheels 37 to facilitate transport of the loader.

Figure 4:
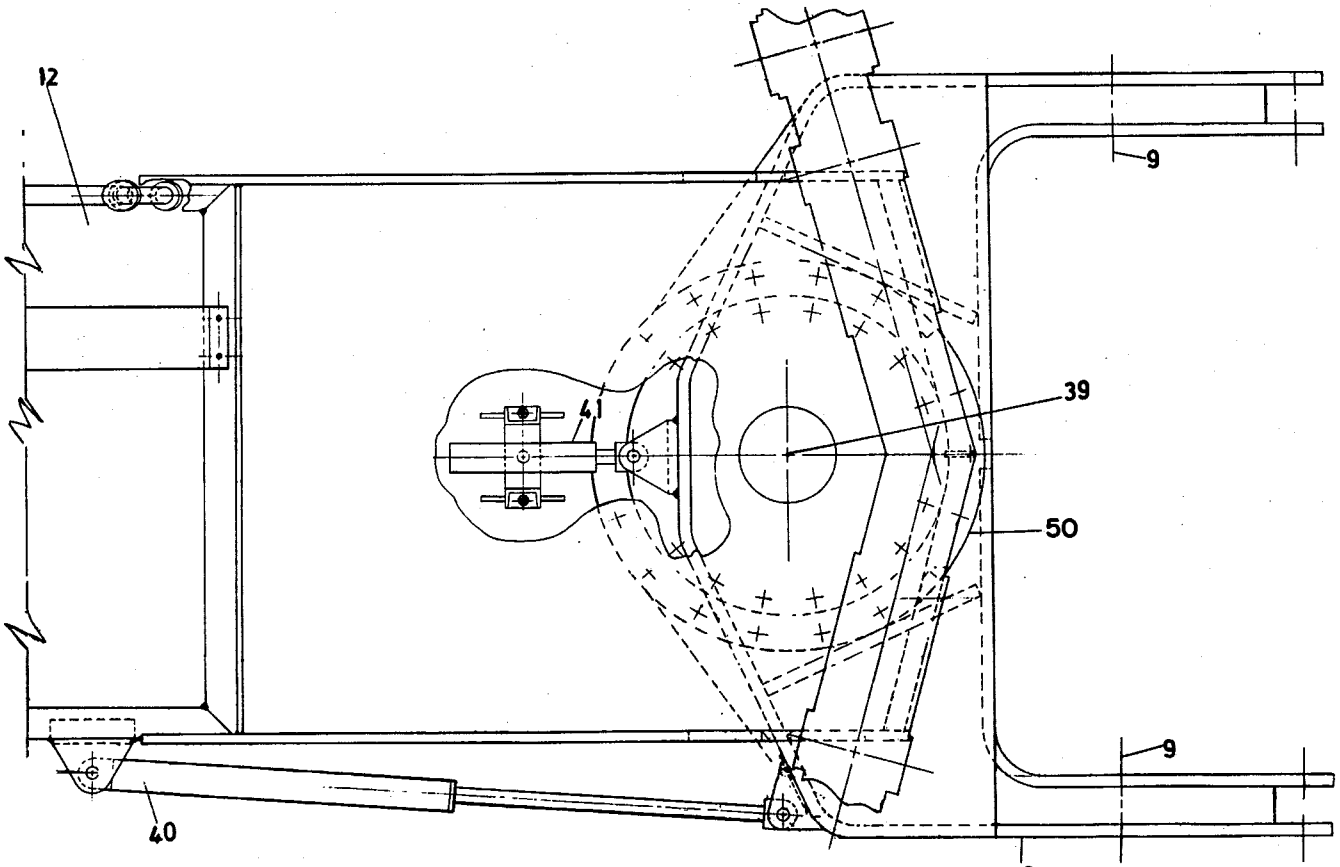
FIG. 4 is a fragmentary plan view to a different scale of the base of the loader.

The base 10 is secured to a turntable 50 (FIG. 4) which can turn about a vertical axis 39. The base 10 is acted upon by two hydraulic cylinders. The first is the double actuating cylinder 40 which allows one to slew the yoke about the axis 39 to increase the width over which the loader can work. The second is a centering cylinder 41 which is single acting. When fluid is admitted to the cylinder 41 it pulls the base 10 to the central position illustrated in FIG. 4. The hydraulic circuit is so arranged that when the dipper arm 17 moves towards the position illustrated in FIG. 2 and to go to the FIG. 5 position, the cylinder 40 is inactivated while fluid is admitted to the cylinder 41. The effect is that the bucket 18 always unloads over the same position.

The loader is caused to operate by actuating a series of hydraulic devices:

(a) the cylinders 19 cause the dipper arm to swing to and fro;

(b) the cylinders 28 cause the yoke to lean forward and to right itself;

(c) the cylinder 35 causes the bucket to assume its load retaining attitude;

(d) the cylinder 40 causes the yoke to slew; and (e) the cylinder 41 causes automatic centering.

(f) the motor 36 applies a bias and also acts as described later on.

In use the cylinders 19 and 28 would normally operate together, but on the backswing the cylinder 35 is locked to retain the bucket 18 in its load retaining attitude B. On the forward swing the cylinder 35 can be actuated for the bucket 18 to perform a dipping and lifting action on the material being mucked. The slewing cylinder can also be actuated on the forward swing. As soon as a backswing to the FIG. 5 position begins both ends of the cylinder 40 are connected to tank.

For mucking the loader is positioned close to a pile of broken rock at the end of a mine tunnel. At that stage the loader assumes the shape shown in FIG. 2 with the bucket 18 in position C and in a digging attitude. The forward swing is then commenced and as the bucket 18 encounters broken rock, the cylinder 35 is actuated for the bucket to dig into and scoop up rock. When the bucket contains sufficient rock, the bucket 18 is caused to assume attitude B and the backswing can commence. Centering takes place while the assembly moves to the FIG. 2 position. Note that on the backswing the bucket 18 retains its attitude B to the floor of the tunnel.

Figure 5:
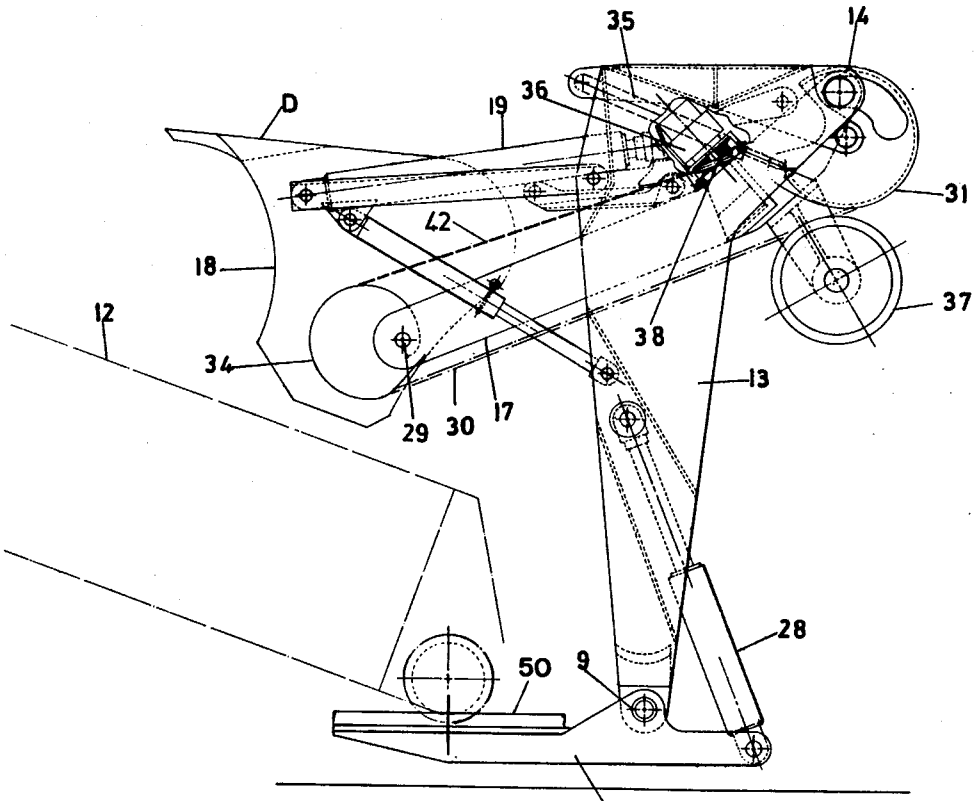
FIG. 5 is a side view of the loader with the dipper arm in the unloading position.

As the assembly moves from the FIG. 2 position with the bucket in attitude B, to the FIG. 5 position, the element 30 gets shortened and the bucket 18 rotates counterclockwise about its pivot 29 to assume attitude D in FIG. 5. The scooped up rock is thus discharged.

Upon return of the dipper arm to the FIG. 2 position the feed to the motor 36 is increased to ensure a positive winching action by the rope 42 which in any case now has an increased mechanical advantage about the pivot 29. The assembly arrives at the FIG. 2 position with the bucket 18 in the load retaining attitude. As the cylinder 35 is unlocked, the bucket 18 moves to its digging attitude C or A.

The operation is repeated by leaning more forwardly each time and by slewing to right and left as required.

When a pile of muck is cleared, the loader is folded to the FIG. 6 position and hauled away by the mucking train. In an actual machine with a bucket having 0,6 $m^3$ capacity the headroom required in the FIG. 2 position is 2,5 meters while the headroom required for travelling is 1,6 meters. The machine can muck up to 1,45 meters to either side of the centre line of the mucking train.

We claim:

1. A loader comprising:

a base;

a yoke extending above the base and having uprights spaced apart at their top ends by a cross-member between the uprights;

a shaft between the uprights;

a dipper arm swinging from the shaft to move to either side of the yoke between the uprights and below the shaft;

means to cause the dipper arm to swing between a loading position at a first side of the yoke and an unloading position at the opposite second side of the yoke;

a bucket pivoted to the free end of the dipper arm about a first axis parallel to the shaft; and means to rotate the bucket about its pivot axis from a digging attitude to a load retaining attitude whereby the bucket is below the horizontal plane containing the dipper shaft during the loading and unloading positions.

2. The loader claimed in claim 1 in which the yoke is pivoted to the base about an axis parallel to the shaft and further including means to cause the yoke to move about said axis parallel to the shaft for the yoke to lean towards the first side of the yoke.

3. The loader claimed in claim 2 in which the yoke is slewable about an axis perpendicular to the base.

4. The loader claimed in claim 3 including means to centralise the yoke as the dipper arm moves to its unloading position.

5. The loader claimed in claim 4 including a cam surface co-operating with the bucket so that with the bucket initially in the load retaining attitude at the loading position of the dipper arm, the bucket turns upside down when the dipper arm reaches the unloading position.

6. The loader claimed in claim 5 in which the cam surface is carried by the bucket, a flexible element extends from the cam surface to a winch and the axes of the winch and the bucket are so positioned that the bucket turns upside down in the unloading position.

7. A loader comprising:

a base mounted for rotation about a vertical axis;

a hydraulic cylinder to slew the base about the vertical axis;

a yoke extending above the base and having uprights spaced apart at their top ends by a cross-member between the uprights, the uprights being pivoted on the base about a leaning axis;

a shaft extending between the uprights parallel to the leaning axis;

a hydraulic cylinder to cause the yoke to move between an erect and a forward leaning position about the leaning axis;

a dipper arm swinging from the shaft to move to either side of the yoke between the uprights and below the shaft;

a hydraulic cylinder to cause the dipper arm to swing between a loading position forwardly of the yoke and an unloading position rearwardly of the yoke;

a bucket pivoted to the free end of the dipper arm about a pivot axis parallel to the shaft;

winch means to cause the bucket to pivot about its pivot axis from a digging attitude to a load retaining attitude; and means to cause the bucket to turn upside down in the unloading position of the dipper arm whereby the bucket is below the horizontal plane containing the dipper shaft during the loading and unloading positions.

8. The loader claimed in claim 7 including means to centralise the base and to immobilise the slewing cylinder.

9. The loader claimed in claim 8 in which the bucket is operated by means of a flexible element extending from a winch wheel mounted eccentrically to the cross-member and around a cammed surface on the bucket, the eccentricity and the shape of the cammed surface being such that in the unloading position the bucket turns upside down.

* * * * *